US005127890A

United States Patent [19]

Norén

[11] Patent Number: 5,127,890

[45] Date of Patent: Jul. 7, 1992

[54] PROTECTIVE SLEEVE FOR JAVELINS

[75] Inventor: Per-Erik Norén, Arvidsjaur, Sweden

[73] Assignee: Nordic Sport Production I Arvidsjaur AB, Arvidsjaur, Sweden

[21] Appl. No.: 596,364

[22] Filed: Oct. 12, 1990

[30] Foreign Application Priority Data

Oct. 13, 1989 [SE] Sweden ..... 8903375

[51] Int. Cl.[5] ..... A63B 65/02

[52] U.S. Cl. ..... 482/20

[58] Field of Search ..... 272/106, 93, 98; 30/138, 151, 143; 76/82; 150/161, 165

[56] References Cited

U.S. PATENT DOCUMENTS

| | | | |
|---|---|---|---|
| 790,234 | 5/1905 | Waldo | 30/151 |
| 3,746,334 | 7/1923 | Stubblefield | 272/106 |
| 3,977,077 | 8/1976 | Rebold | 30/151 |
| 4,404,053 | 9/1983 | Saffire | 272/106 |

*Primary Examiner*—Stephen R. Crow
*Attorney, Agent, or Firm*—Cushman, Darby & Cushman

[57] ABSTRACT

A protective sleeve assembly for a javelin, particularly for a competition or training javelin, including an outer sleeve made of an elastic material, and an inner sleeve which is located a socket axially provided in the outer sleeve. The inner sleeve has a recess which is intended to receive a forward part of a javelin tip. The outer sleeve has a tubular axially trailing part, the inner diameter of which is such as to obtain an elastic, squeeze fit around a rear part of the javelin tip. The outer sleeve has an internal recess which accommodates the inner sleeve. Similar to the forward end of the inner sleeve, the forward end of the outer sleeve is also of externally, frontally hemispherical shape. The inner sleeve is located in the axially leading part of the outer sleeve. The protective sleeve assembly can contribute to safety, by reducing the risk of serious injury to persons in conjunction with javelin-throwing exercises.

4 Claims, 1 Drawing Sheet

PROTECTIVE SLEEVE FOR JAVELINS

BACKGROUND OF THE INVENTION

The present invention relates to a protective sleeve assembly for javelins, and particularly for competition and training javelins.

In connection with javelins used in competitive sports, there is sometimes the need to fit onto the pointed tip of the javelin a guard or protective device in order, for instance, to increase safety during practice throws. The protective device thus contributes to safety, by reducing the risk of serious injury to persons who might be grazed or struck by a javelin in flight.

SUMMARY OF THE INVENTION

The object of the present invention is to provide an extremely simple and effective javelin-tip guard in the form of a protective sleeve assembly.

The protective sleeve assembly of the present invention can be readily fitted to the tip of a javelin and has the ability to remain affixed thereto. Furthermore, the inventive protective sleeve is highly wear resistant and is mechanically strong, and consequently the protective sleeve assembly has a very long useful life, based on the number of times the javelin is thrown. cl BRIEF DESCRIPTION OF THE DRAWING The invention will now be described in more detail with reference to an exemplifying embodiment thereof illustrated in the accompanying drawing, in which: FIG. 1 is a longitudinal section view of a protective sleeve assembly embodying principles of the present invention, and fitted onto the tip of a javelin, FIG. 2 is a partial, longitudinal sectional view, of the protective sleeve assembly shown in FIG. 1 and FIG. 3 is a full longitudinally sectional view illustrating on a larger scale, the inner sleeve component of the protective sleeve assembly.

DETAILED DESCRIPTION

Figure 1:
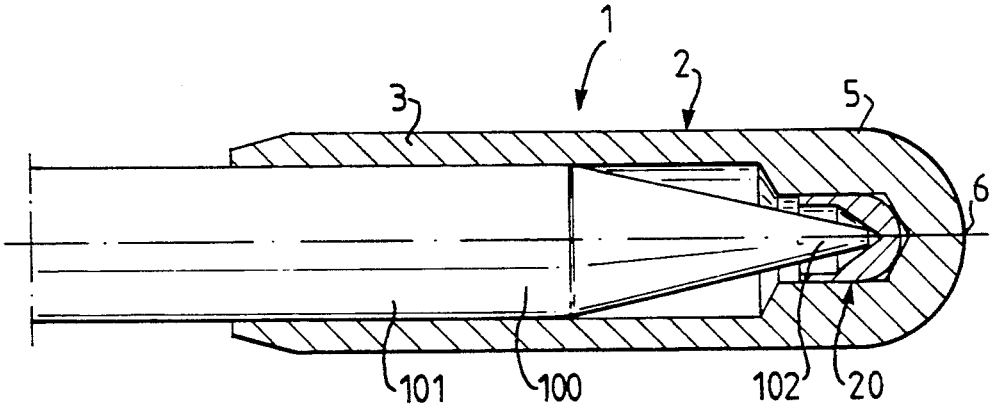

The protective sleeve assembly 1 includes an outer sleeve 2 which made of an elastic or resilient material, for instance a rubber or plastic material. A non-limiting example of a material suitable in this respect is neoprene rubber. The outer sleeve 2 has a relatively thin-walled and cylindrical or tubular top, i.e., axially trailing part 3, and a relatively thick-walled bottom part 5. (The term "top" and "bottom" are used in a sense of indicating their usual relative position when the javelin on which the protective sleeve assembly is mounted, upon being thrown along an arching path, penetrates the ground, with its tip pointed downwards and its shaft trailing upwards axially therebehind.) The bottom part 5 c loses the outer sleeve 2 at its forward end 6, this forward end of the sleeve 2 preferably being so rounded as to present a forwardly, externally hemispherical or dome-like configuration, although the forward end of the sleeve may have other shapes, of course. The rearward end 7 of the sleeve 2 has an external chamber 8.

Figure 2:
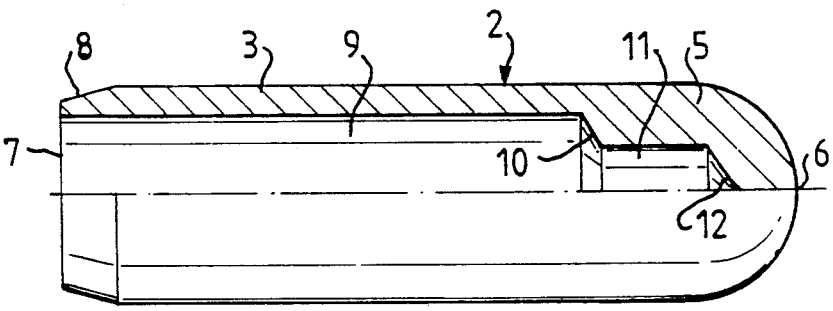

When seen from the rear, open end 7 of the sleeve, the forward end region corresponding to the tubular top part 3 and to the dome-shaped surface of the outer sleeve 2 respectively has a cylindrical recess or hollow 9 which merges, via a conical transition surface 10, with a cylindrical or hollow recess 11 located in the bottom part 5 of the sleeve. The diameter of the cylindrical recess 11 is smaller than the diameter of the recess 9 and the recess 11 merges with a conical, pointed recess 12, as will best be seen from FIG. 2.

Figure 3:
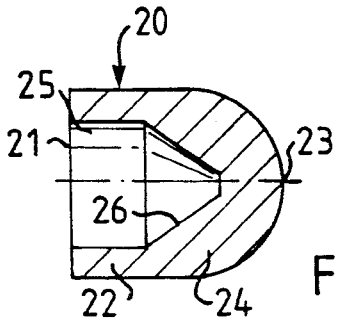

The protective sleeve assembly 1 also includes an inner sleeve 20, illustrated in FIG. 3. The rear (i.e., trailing) end 21 of the inner sleeve 20 has a cylindrical or tubular top (i.e. trailing) part 22, and the forward end 23 of said inner sleeve has a bottom (i.e. leading) part 24. The forward end 23 of the inner sleeve 20 is externally frontally rounded and has a hemispherical or dome-like shape. Located in the rear end 21 of the inner sleeve 20 is a cylindrical recess or hollow 25 which merges with a conical and pointed recess 26 located in the bottom (i.e. leading) part 24 of said inner sleeve 20.

The outer diameter of the inner sleeve 20 is so adapted in relation to the diameter of the recess 11 in the outer sleeve 2 as to enable the inner sleeve 20 to be squeezed into the recess 11 and held firmly therein as a result of squeezing forces and frictional forces acting thereon, wherein the forward end 23 of the inner sleeve 20 bottoms on the (i.e. engages) the conical recess 12 in the outer sleeve 2 and abuts parts of said recess. Thus, when fitted, the inner sleeve 20 will remain in the outer sleeve 2 and the inner and outer sleeves 20 and 2 together form the inventive protective sleeve assembly 1.

The inner sleeve 20 is suitably made of metal, for instance steel, although other materials may also be used.

The inventive protective sleeve assembly 1 is fitted onto the tip or point 100 of a javelin in the manner illustrated in FIG. 1. The diameter of the cylindrical recess 9 of the outer sleeve 2 is such that the protective sleeve assembly is squeezed elastically around the rear (i.e. axially trailing) part 101 of the javelin tip 100 when the forward (i.e. axially leading) part 102 of the javelin tip 100 is forced to the bottom (i.e. axially leading) of the conically pointed recess 26 in the inner sleeve 20. The cylindrical, tubular part 3 of the outer sleeve 2 is thus dimensioned so as to achieve elastic squeezing against the rear part 101 of the javelin tip 100, such that the protective sleeve assembly 1 will effectively remain seated on the javelin tip during use of the javelin, as a result of the inherent elasticity of the protective sleeve assembly.

The aforedescribed inner sleeve 20 is particularly important in the present context, since it spreads the load from the forward part 102 of the javelin tip and thereby prevents the point of the javelin from penetrating the bottom part 5 of the outer sleeve 2 as the javelin strikes the ground at the end of its trajectory.

It should be mentioned that the protective sleeve assembly 1 will not influence the trajectory of the javelin through the air in a negative manner, and hence the quality of the training throw will be fully acceptable.

It will be understood that the configuration of the outer sleeve 2 and the inner sleeve 20 can be varied within the scope of the concept of the invention. For instance, the configuration of the forward end 6 of the outer sleeve can deviate from the illustrated hemispherical configuration, and the configuration of the recesses 9–12 can also deviate from the described and illustrated configuration. For instance, the conical and pointed recess 12 may be spherical, so as to conform shape-wise with the forward, hemispherical end 23 of the inner sleeve 20. It will also be understood that the configuration of the inner sleeve 20 can also be varied. For instance, the forward end 23 may be conical and coincide shape-wise with the conical recess 12, and so on. With regard to the recesses 25 and 26, these recesses may also be varied within the scope of the inventive concept, so as to obtain satisfactory guiding and accommodation of the forward part 102 of the javelin tip 100.

Furthermore, if desired, the elastic outer sleeve 2 can be reinforced so as to improve its mechanical strength still further.

The invention is thus not restricted to the illustrated and described embodiments, since changes and modifications are possible within the scope of the following claims.

I claim:

1. A protective sleeve assembly for the axially leading tip end of a javelin having an externally, forwardly tapering tip axially leading a trailing externally cylindrical shaft having a given diameter, said protective sleeve assembly comprising:

an outer sleeve having a tubular sidewall and an axially forward end wall, thereby defining a rearwardly open, forwardly closed socket having an internal peripheral sidewall surface, and, in said forward end wall, a rearwardly opening recess having a smaller internal diameter than does said inner peripheral sidewall surface;

an inner sleeve having a tubular sidewall and an axially forward end wall, thereby defining a rearwardly open, forwardly closed socket having an internal peripheral sidewall surface, and, in said forward end wall of said inner sleeve, a rearwardly facing end wall surface;

said inner sleeve being coaxially frictionally grippingly received in said recess of said socket of said outer sleeve;

the sockets of the outer and inner sleeves being arranged to axially telescopically receive a forward portion of a javelin so that the tapering tip of the leading end of the javelin is disposed in said socket of said inner sleeve, and the trailing shaft of the javelin, axially adjacent said tapering tip is frictionally grippingly engaged by said inner peripheral sidewall surface of said outer sleeve;

said outer sleeve being made of a resilient, elastic material selected from the group consisting of rubber and plastic, and said inner sleeve being made of a material capable of spreading radially outwards load which said javelin tip tends to apply axially centrally to said forward end wall of said outer sleeve when the javelin is thrown.

2. The protective sleeve assembly of claim 1, wherein:

said inner sleeve is made of steel.

3. A protectively sleeved javelin, comprising:

a javelin having an externally, forwardly tapering tip axially leading a trailing externally cylindrical shaft having a given diameter, said tapering tip being provided at an axially leading tip end of the javelin; and a protective sleeve assembly for said leading tip end, said protective sleeve assembly comprising:

an outer sleeve having a tubular sidewall and an axially forward end wall, thereby defining a rearwardly open, forwardly closed socket having an internal peripheral sidewall surface, and, in said forward end wall, a rearwardly opening recess having a smaller internal diameter than does said inner peripheral sidewall surface;

an inner sleeve having a tubular sidewall and an axially forward end wall, thereby defining a rearwardly open, forwardly closed socket having an internal peripheral sidewall surface, and, in said forward end wall of said inner sleeve, a rearwardly facing end wall surface;

said inner sleeve being coaxially frictionally grippingly received in said recess of said socket of said outer sleeve;

the sockets of said outer and inner sleeves axially telescopically receiving a forward portion of a javelin so that the tapering tip of the leading end of the javelin is disposed in said socket of said inner sleeve, and the trailing shaft of the javelin, axially adjacent said tapering tip is frictionally grippingly engaged by said inner peripheral sidewall surface of said outer sleeve;

said outer sleeve being made of a resilient, elastic material selected from the group consisting of rubber and plastic, and said inner sleeve being made of material capable of spreading radially outwards load which said javelin tip tends to apply axially centrally to said forward end wall of said outer sleeve when the javelin is thrown.

4. The protectively sleeved javelin of claim 3, wherein:

said inner sleeve is made of steel.

* * * * *